United States Patent [19]

Stinger, Jr.

[11] Patent Number: 4,515,997

[45] Date of Patent: May 7, 1985

[54] DIRECT DIGITAL LOUDSPEAKER

[76] Inventor: Walter E. Stinger, Jr., 423 Anthwyn Rd., Narberth, Pa. 19072

[21] Appl. No.: 422,219

[22] Filed: Sep. 23, 1982

[51] Int. Cl.[3] ..... H04R 19/02; G08C 9/02

[52] U.S. Cl. ..... 179/111 R; 340/347 DA

[58] Field of Search ..... 179/111 R, 105, 107 FD, 179/107 BC, 115.5 R, 110 A; 329/193; 340/347 DA

[56] References Cited

U.S. PATENT DOCUMENTS

| | | | |
|---|---|---|---|
| 3,153,229 | 10/1964 | Roberts | 310/24 |
| 3,286,032 | 11/1966 | Baum | 179/114 M |
| 3,476,887 | 11/1969 | Seligson et al. | 179/113 |
| 3,622,791 | 11/1971 | Bernard | 179/121 R |
| 3,626,096 | 12/1971 | von Muench | 179/111 R |
| 3,947,708 | 3/1976 | Fulenwider | 179/110 A |
| 3,958,237 | 5/1976 | Fulenwider | 179/111 R |
| 4,034,332 | 7/1977 | Alais | 179/111 E |
| 4,122,302 | 10/1978 | Bobb | 179/146 E |
| 4,194,095 | 3/1980 | Doi et al. | 179/113 |
| 4,332,979 | 6/1982 | Fischer | 381/18 |

FOREIGN PATENT DOCUMENTS 1382927 2/1975 United Kingdom .

*Primary Examiner*—Gene Z. Rubinson

*Assistant Examiner*—Danita R. Byrd

*Attorney, Agent, or Firm*—John F. A. Earley; John F. A. Earley, III

[57] ABSTRACT

A method of and apparatus for converting a digital signal to sound, the digital signal being encoded in a sequence of code words at a signal encoding frequency, the code words representing the analog sound pressure of an original audio signal, with decoding of the digital signal occurring after electro-acoustic transduction through mechanical rectification and characteristics of a listener's ear, includes utilizing a plurality of substantially identical sound pressure generating elements each having an individual driver associated therewith, and selectively energizing the drivers in a pulsed manner at the signal encoding frequency in combination in response to a respective order of the bits of each code word of a digital signal from a most significant bit to a least significant bit. The sum of the air pressures produced by the sound pressure generating elements in response to each of the successive code words of the digital signal has a magnitude corresponding to the analog value of the respective code word, and the auditory system of the listener has the characteristics of a low pass filter whereby the listener receives the sum of the air pressures as the analog sound pressure of the original audio signal.

22 Claims, 4 Drawing Figures

DIRECT DIGITAL LOUDSPEAKER

BACKGROUND OF THE INVENTION

1. Field of the Invention

The present invention relates to a loudspeaker that directly, with high fidelity, converts into an acoustic output digitally-encoded electrical signals that are representative of such output.

2. Description of the Prior Art

Conventional vibrating plate or diaphragm-type loudspeakers are analog devices. In general, because of the inertia of the vibrating diaphragm and for other reasons, such loudspeakers are known to have low efficiency and high distortion characteristics. It is difficult, also, to produce low frequency sounds with a small size speaker. These and other inherent deficiencies limit the extent to which the fidelity of reproduction of diaphragm-type speakers can be improved and their cost of manufacture, assembly and maintenance reduced.

It is known in the prior art to convert audio signals, such as voice or musical signals, into a pulse code modulation (PCM) signal which is then recorded for later reproduction or transmitted to a distant point for reproduction over a telephone line, for example. This enables audio signals to be recorded or transmitted and then reproduced. Specifically, the analog voice signal is sampled at a constant rate, commonly 44 kHz, and a digital word is produced and transmitted at each sampling, the digital word representing the polarity and magnitude of the analog voice signal at the time of sampling. The digital word is converted back to an analog voice signal which is then applied to a conventional speaker. Significantly, however, for sound reproduction, it is necessary to convert the PCM signal into an audio signal. That is to say, before electro-acoustic conversion, a digital-to-analog converter that can accept PCM signals must be provided to convert the PCM signal into an analog signal that the speaker will accept. The use of such a converter not only increases the cost but introduces signal distortion produced by conversion and amplification. Moreover, the system is still subject to distortion and coloration of sound produced by analog loudspeakers as well as their inefficiency.

It has been proposed in the prior art to provide digitally controlled transducers which decode a digitally-encoded signal received serially by code word to drive a single analog speaker diaphragm. In British Pat. No. 1,382,927, the complete specification for which was published on Feb. 5, 1975, the transducer comprises a cantilevered piezoelectric bender plate having a plurality of driving electrodes of varying areas and each of which is energizable independently of the others by an electrical signal the magnitude of which is determined for each code word by the value of the digital signal in a respective bit position thereof. One end of the bender plate is fixed and the other end is connected to a speaker diaphragm. A similar arrangement is disclosed in U.S. Pat. No. 3,947,708 that was issued on Mar. 30, 1976 to John E. Fulenwider. U.S. Pat. No. 3,153,229 that was issued on Oct. 13, 1964 to C. E. Roberts discloses a direct digital transducer employing an electrorestrictive plate providing a digital readout of an analog function without intermediate conversion to an analog number.

Significantly, in the devices of all three of the above patients, digital-to-analog conversion occurs before electro-acoustic transduction.

Microphones for converting acoustic energy, through a single diaphragm, directly to a digitally-encoded electrical signal are disclosed in the following U.S. Pat. Nos. 3,286,032 issued on Nov. 15, 1966 to Elmer Baum; 3,622,791 issued on Nov. 23, 1971 to Patrice H. Bernard; 3,626,096 issued on Dec. 7, 1971; and 3,958,237 issued on May 18, 1976. The acoustic conversion methods employed in these patents rely upon the use of a single diaphragm, and do not lend themselves to "reverse engineering" for use as loudspeakers.

An ionic electro-acoustic transducer employed as a loudspeaker is disclosed in U.S. Pat. No. 3,476,887 that was issued on Nov. 4, 1969 to A. L. Seligson et al. All detailed discussion of this transducer in the specification of the patent is concerned with the transducer as an analog device. A single reference to "digital" modulation is made in Column 2, line 9 of the specification, but there is no discussion or other disclosure of this, in either the specification or drawings.

Ultrasonic transmitting and receiving devices using dielectric transducers are disclosed in U.S. Pat. No. 4,034,332 that was issued on July 5, 1977 to Pierre M. Alais. These devices transmit ultrasonic wave pulses into an outer liquid or solid medium while focusing the pulses in predetermined and adjustable directions or distances and for detecting such wave pulses.

A direct digital loudspeaker with digital-to-analog conversion occurring after electro-acoustic transduction is disclosed in U.S. Pat. No. 4,194,095 that was issued on Mar. 18, 1980 to Toshitada Doi et al., the disclosure of which patent, by reference, is incorporated herein. This loudspeaker depends for its operation upon the switching, that is, the turning off and on, at an ultrasonic rate, of several digital bit related (air) outlet valves. The air outlets comprise horns that are sized to relate to the significance of the digital bits in the coded signals which control them. The air supply includes a pump and a reservoir.

The loudspeaker of U.S. Pat. No. 4,194,095 involves a large number of mechanical parts such as the air pump and the reservoir, output horns, precision valving and piloting mechanism, and multiple air ducts. The valve driving electronics involves several stages of wave shaping to drive the device from a normal serially coded signal in addition to a serial-to-parallel "buffer." Also, the acoustic output is one-sided, providing positive pressure toward the listener, rather than the preferred push-pull mode of operation. Further, the actual overall fidelity of the sound produced by this speaker system would be reduced by the extraneous noise made by the pumping and duct systems.

SUMMARY OF THE INVENTION

An object of the invention is to provide an improved loudspeaker that directly, and with high fidelity, converts digital electrical signals into an acoustic output with digital-to-analog conversion occurring after electro-acoustical transduction.

Another object of the invention, with respect to loudspeakers, is to eliminate the need for electrical digital-to-analog conversion and the high quality analog audio amplifiers required in the prior art when using a digitally-encoded program source, thereby to enable a reduction of signal distortion produced by conversion and amplification and a reduction of distortion and coloration of sound produced by analog loudspeakers.

A further object of the invention is to provide a method enabling the use of mass-produced digital processing circuitry and mass-production techniques for loudspeaker manufacture.

Still another object of the invention is to provide a loudspeaker that is operative to provide an acoustic output directly from a digitally-encoded signal, with lower power loss, lower power consumption, and greater efficiency.

A further object of the invention is to provide such a loudspeaker in which sound pressure can be reduced to zero instantly thereby to produce a sound pressure waveform that is substantially the same as the original audio waveform.

A specific object of the invention is to provide such a loudspeaker that is adapted for push-pull operation.

Another specific object of the invention is to provide such a loudspeaker that is characterized by being an area producer in which every part of the speaker produces sound, and in which the speaker may be planar or formed with concave or convex surfaces, as desired.

A further specific object of the invention is to provide such a loudspeaker in which there are a minimum of moving parts, thus minimizing manufacturing, assembly and maintenance costs.

In accomplishing these and other objectives of the present invention, there is provided a direct digital loudspeaker comprising a plurality of substantially identical low inertia sound pressure generating elements or transducers, each of which elements or transducers has a drive individually associated therewith for producing the discrete sound levels encoded in a digitally-encoded signal, a PCM signal, for example, that is received serially by code word, with the drivers arranged in an array or "soundel" that is capable of producing the full range of the encoded sound. Soundels may be connected in parallel and built up into larger speaker panels that may be planar, or formed with concave or convex surfaces, and of a size appropriate for overall sound levels and power handling. The individual drivers may be pulsed at the encoding carrier frequency rate, commonly, 44 kHz, as mentioned above. The total number of drivers on, or powered, during any given pulse would correspond directly to the encoding of the digital word for that pulse. For example, if bit 1 of the commonly used 16 bit word is on, only one driver will be powered during the pulse for that word; if bit 5 is on, 16 drivers will be powered.

In accordance with the invention, the audio signal is, in effect, an amplitude modulation of a 44 kHz carrier. In order to demodulate the digitally-encoded signal, mechanical rectification is used. A requirement for achieving this is a capability of rapid repetitive response, at the carrier frequency, by each individual driver to an electrical pulse of given polarity without appreciable overshooting upon returning to rest.

In order to provide a zero level for the reproduction of the encoded audio signal (not one driver is powered), the last bit of the encoded signal may be used as an inversion command to invert not only the polarity of the driving power pulse to each driver but also the encoding. By way of example, a word of all "zeros" would power all of the drivers in the negative direction and a word of all "ones" would power all of the drivers in the positive direction. A word with all "ones," except for the 16th bit (in the common 16-bit word) would produce no output of the speaker or no drivers powered on. It is contemplated that positively and negatively driven would correspond to toward and away from the listener, respectively.

Listening level control, as distinguished from signal level, would be controlled by varying the level of the pulses delivered by the drivers. At each pulse all drivers which are "on" receive the same delivered pulse level.

The serially coded audio signal is converted to parallel pulses with a buffer. The parallel pulses are used to gate, directly, the driving power for each digital bit related sound generating element or transducer group. The individual transducers may be small, low cost, mass-produced devices that may be one of many possible types and are arrayed to provide an output for each digital bit related to the significance of that bit in the coded word. Such arrays or soundels corresponding to a complete set of code bits can be placed in parallel to obtain a desired sound power capability.

As mentioned hereinbefore, the transducers may be driven in both directions by the driving power depending upon the coding thereby to yield a push-pull acoustic output. Overall listening volume level is controlled simply by varying the driving power level.

The summation of the sounds, more specifically, the air pressure variations produced by the arrayed transducers is received by the listener. This summation has a magnitude corresponding to the analog value of each frame of the PCM rate. The listener, therefore, receives the air pressure in a pulse amplitude modulated (PAM) condition. Since the human ear, the auditory response mechanism of the listener, inherently has the characteristics of a low pass filter, the listener receives the air pressure from the arrayed transducers in PAM condition as the sound pressure of the original audio signal. Thus, the decoding of the digital or PCM signal occurs after transduction through the inherent acoustic characteristics of the human ear.

As those skilled in the art will recognize, a possible embodiment of the present invention could have all component parts from the buffer to the driving power supply, the gates and the transducers, produced on a single integrated circuit chip. Such an embodiment of the invention would be appropriate for use as an earphone.

Another embodiment of the invention comprises a modification of this, using many physically separate transducers to provide the sound power required of a high fidelity loudspeaker. A characteristic feature of such a speaker embodiment is its capacity to produce an "area" of sound, thus enhancing the "audio transparency" preceived by a listener.

Both of these embodiments of the invention are characterized in their relative simplicity, mechanically and electrically, compared to the speaker system of the aforementioned U.S. Pat. No. 4,194,095. Not only do each of these embodiments enable a substantial reduction in the cost of manufacturing, assembling and maintenance, but they are better suited, inherently, to provide a more acceptable acoustic result over a large range of power capabilities.

DESCRIPTION OF THE PREFERRED EMBODIMENTS

Figure 1:
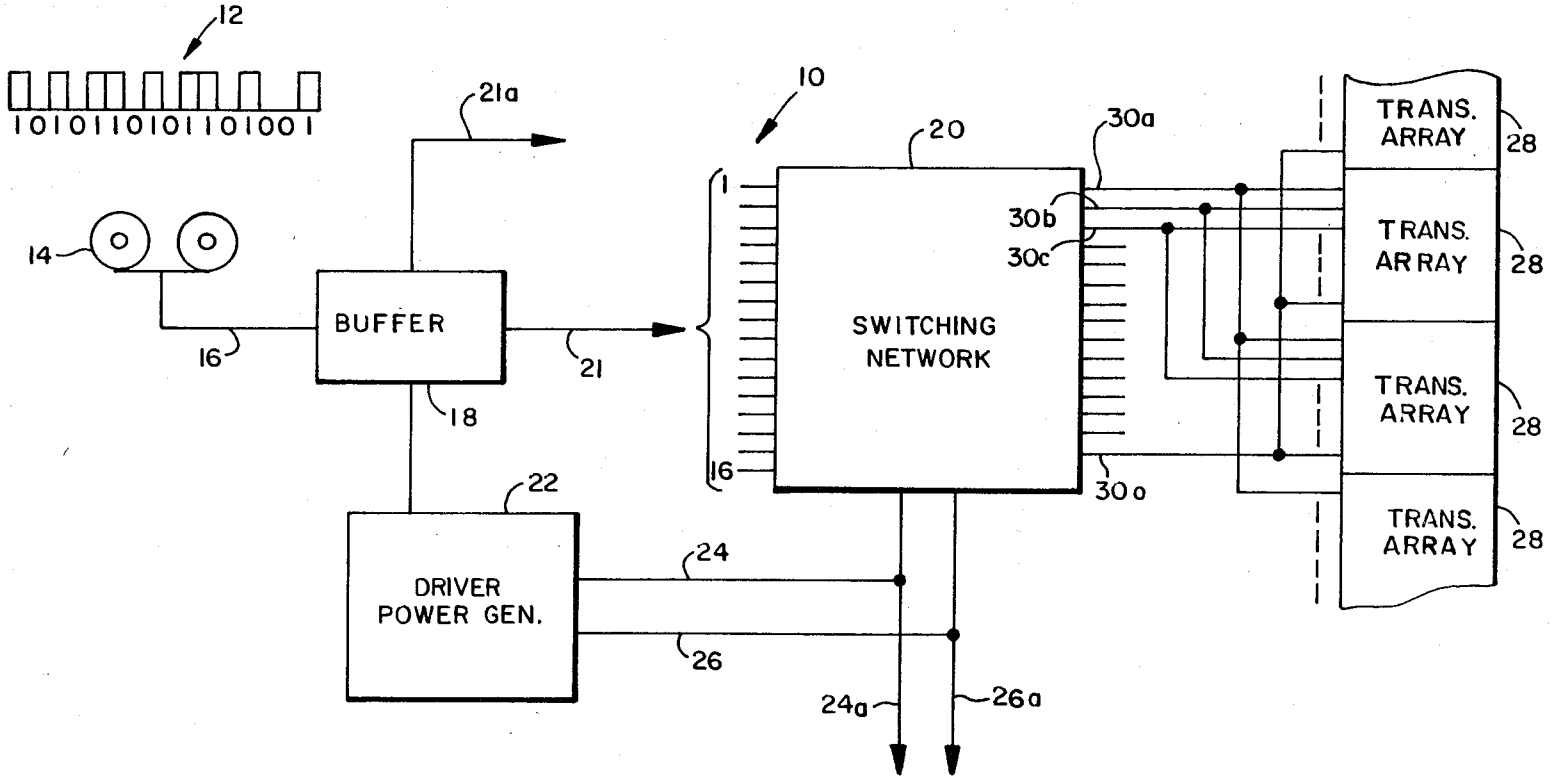
FIG. 1 is a block diagram illustrating a signal circuit for driving the transducer arrays or soundels comprising the loudspeaker according to the present invention.

In FIG. 1 there is illustrated an apparatus 10 for converting into sound a digital word having a plurality of magnitude bit locations indicated at 12, and received serially by code words. There are many uses for such apparatus such as reproducing electrical analog or audio signals that have been recorded in digital form. Another use resides in telecommunication systems in which analog electrical voice signals are transmitted in digital form.

In FIG. 1 it is contemplated that an analog electrical audio signal at a transmitter 14 is sampled at a constant rate of 44 kHz and a digital word is transmitted at each sampling with the digital word representing the polarity and magnitude of the analog audio signal at the sampling time.

According to the present invention, there is no conversion of the digital signal to an analog electrical signal. Instead, the digital signal is converted directly into an acoustic output with decoding occurring after transduction. In the preferred embodiment illustrated, the digital word 12 has sixteen (16) bits. The first bit on the right is the least significant bit, and the next to the last bit counting from right to left is the most significant bit. The last, or leftmost bit represents polarity and may serve, also, as a synchronizing bit.

The digital word is transmitted to the apparatus 10 over a line 16 which may be a transmission line, the word 12 being in serial form. The serial word 12 is directed to a serial-to-parallel converter and buffer 18. In the converter and buffer 18, the serially received bits are converted into a plurality of parallel voltages suitable for actuating a switching network 20, which voltages are applied to network 20 by sixteen leads collectively indicated at 21. The converter and buffer 18 also provides a synchronizing signal responsively to the left-most bit of the digital word 12 for controlling a driver power generator 22 to provide driver power signals over lines 24 and 26 to the switching network 20, positive pulses being supplied over line 24 and negative pulses over line 26.

Switching network 20 comprises a network of thirty high speed switches, which may be solid state switches or gates, that represent positive and negative control for the fifteen level bits of each digital word 12. As shown, there are fifteen output connecting leads from the network 20 to each of a plurality of arrays of transducers. Each of the transducer arrays, also termed soundels herein, is designated by the reference numeral 28 in the drawings, four such arrays only being shown in FIG. 1 with two arrays in fragmented form.

The thirty switches in network 20 switch the pulsed driving power for each encoded word for the individual drivers within the arrays or soundels 28. The driving power may be generated using the signal code rate on the buffer reference clock as synchronization. Both positive and negative pulsed driving power at the 44 kHz carrier rate would be delivered to the switching network 20. The switching network 20 may then feed each individual driver in each array 28 and all parallel arrays 28 with a positive or negative voltage, the polarity depending upon the state of an additional switch or gate in network 20, said switch controlling over which line 24 or 26 power is delivered to the output lines 30*a* to 30*o*. This additional switch is controlled by the state of bit 16 of the digital signal 12.

The voltage on the uppermost connecting lead 30*a* at the output of the switching network 20 represents the most significant bit of the digital word 12 and the voltage on the lowermost connecting lead 30*o* represents the least significant bit.

The construction of the arrays or soundels 28 requires a large number of small individual drivers, as described above. The drivers may be of piezoelectric, dynamic, electrostatic or other design. Arrays of piezoelectric drivers may be produced by controlled crystal growth or etching. Electrostatic driver arrays may be produced through an adaptation of available "waffle" packaging techniques involving plastic film and foil conductor or electrodeposited conductor. Such an arrangement results in a flexible array, or a rigid array if bonded to a rigid substrate.

In order to reduce the total number of drivers required, a set of nested soundels or arrays of increasing size, and power, may be used or multiple driving power levels for equal sized soundels may be used.

Figure 2:
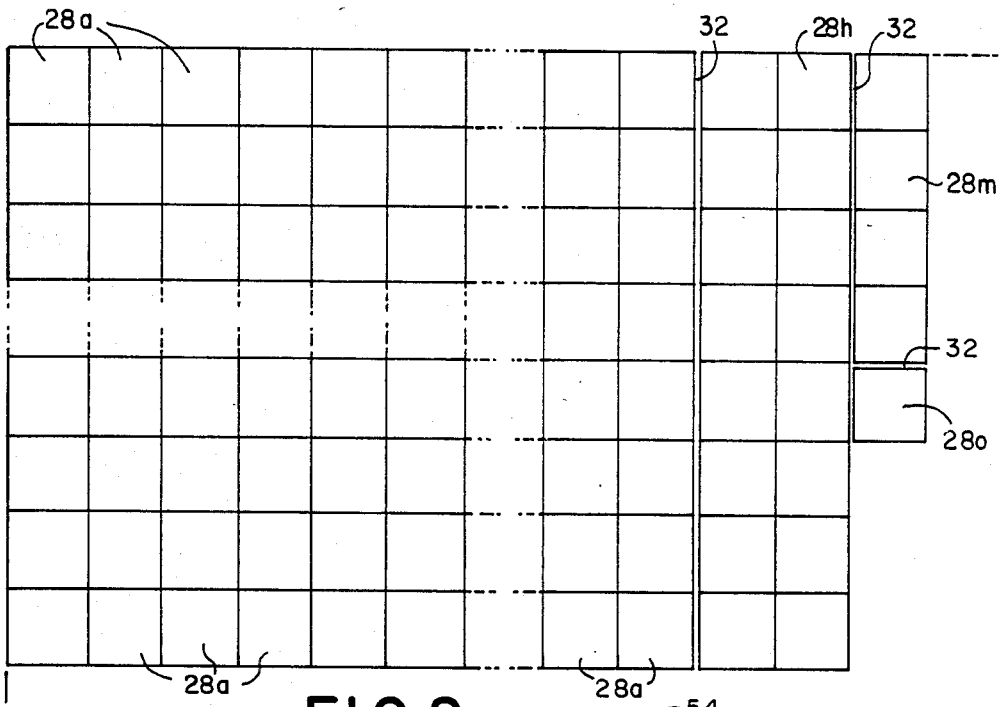
FIG. 2 is a fragmented view illustrating the composition of a transducer array or soundel according to the invention.
Figure 3:
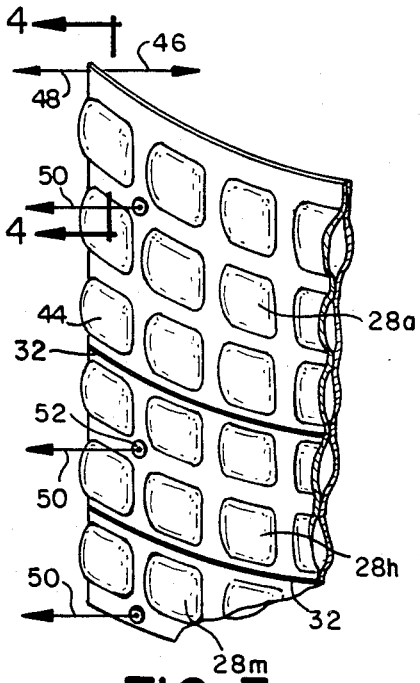
FIG. 3 is a fragmented perspective view of a preferred embodiment of the invention employing a "waffle pack" electrostatic form of transducer array or soundel.
Figure 4:
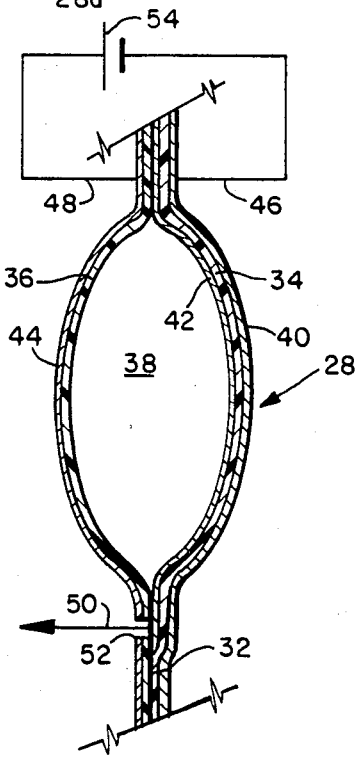
FIG. 4 is a cross section of a typical "waffle pack" transducer as taken along the lines 4—4 of FIG. 3.

The structure and arrangement of each of the transducer arrays or soundels 28 according to a preferred embodiment of the invention is illustrated in FIGS. 2, 3 and 4. As shown in FIG. 2, which is a top plan view of a portion of a transducer array 28, each such array includes a plurality of individual transducer sound pressure generating elements that for convenience are designated 28*a*, 28*b*, 28*c*–28*o*, not all transducer sound pressure generating elements of the array being shown. The elements indicated at 28*a*, not all of which are shown in FIG. 2, are activated by the most significant bit of the digitally-encoded signal; those indicated at 28*h* and 28*m* are activated by less significant bits and that indicated at 28*o* is activated by the least significant bit.

Each of the transducer sound pressure generating elements 28*a*–28*o* has a driver that is individually associated therewith, a driver such as is illustrated in FIGS. 3 and 4. In one embodiment of the invention it is contemplated that such drivers may be energized by way of the switching network 20 in combinations of decreasing arithmetic progression, the constant being two, in response to the respective order of the bits of the digitally-encoded input signal 12 from the most significant bit to the least significant bit. It will be understood, however, that, if desired, the drivers may be energized in other suitable combinations.

FIG. 3 illustrates an embodiment of the invention wherein the individual transducing elements and their associated driving means are formed in a so-called "waffle" pack. In FIG. 3 heavy lines, as shown at 32, indicate bit boundaries. FIG. 4 is a cross section taken along the lines 4—4 of FIG. 3, showing the structure of a typical waffle pack individual transducer sound generating element.

As shown in FIG. 4, each transducer element 28*a*, etc. includes spaced plastic films 34 and 36 between which an enclosed space 38 is formed. The material of which films 34 and 36 is formed may comprise any suitable flexible plastic, such for example, as polyethylene. Plastic film 34 has an electrically conducting film 40 deposited or bonded on the outside side wall thereof and an electrically conducting film 42 deposited or bonded on the inside wall. The plastic film 36 has an electrically conducting film 44 deposited or bonded on the outside wall only. The conducting film 42 on the inside wall of film 34 engages the non-conducting inside wall of film 36 in the region between adjacent transducer elements in all directions of the array except at the bit boundaries, as indicated at 32.

Electrical connections are made to each of the transducer elements 28*a*, etc. by wires that are electrically bonded to the conducting film. Specifically, wires 46 and 48 are bonded, respectively, to the outer conducting films 40 and 44, and a wire 50 is bonded to the inner conducting film 42 through a small opening 52 in the conducting film 44 and plastic film 36, wire 50 being suitably electrically insulated from conducting film 44.

Gas, for example, air, within the space 38 of each transducer element is sealed in with a slight positive pressure, the respective layers comprising film 34 and conductive films 40 and 42, and the film 36 and conductive film 44, being bonded together.

A direct current bias voltage which may be derived in any suitable manner from the driver power generator 22 or from any other suitable source such as a battery 54 is applied between the conducting wires 46 and 48. This voltage tends to slightly compress the gas in space 38 due to the electrostatic attraction between the outer conducting films 40 and 44.

An alternating current signal, specifically the 44 kHz pulse audio signal, is applied from an associated one of the output lines 30*a*–30*o* between conducting wires 46 and 50 with a maximum amplitude of less than the direct current bias voltage. As the alternating current signal varies, the gas in space 38 will be compressed to a greater or lesser degree due to the varying electrostatic attraction between the conducting film layers 34, 40, 42 and 36, 44. Consequently, the two layers are moved toward and away from each other to compress the external air at the surfaces thereof proportionally to the impressed alternating current signal, thereby to produce sound waves.

Bit boundaries are formed, as indicated at 32, by making the conducting film layer 42 discontinuous. The outer conducting layers 40 and 44 are continuous.

As indicated in FIG. 1, it is contemplated that the digital signal on line 16 from transmitter 14 may be a stereo signal, the output from buffer 18 over leads collectively indicated at 21 being for the stereo channel shown and described, and a second output from buffer 18 collectively indicated at 21*a* being for the other stereo channel (not shown), lead 24*a* and 26*a* from driver power generator 22 also being provided for the other stereo channel.

As those skilled in the art well understand, the preferred embodiment described above can, if desired, be constructed as a single-sided arrangement. This is to be distinguished from the double-sided or push-pull function described above wherein the "waffle" transducer reacts in compression and expansion.

For operation in a single-sided mode, the outside conducting film 40 shown in FIG. 4 is not needed, and not used. The most significant bit in the code word 12 would not, in such a modified arrangement, represent polarity reversal of the driving pulses but would, itself, drive a value related set of sound pressure generating elements or transducers in the array of transducers. It is noted that with this mode of operation, as compared to the push-pull mode, a doubling of the total array or soundel area and the number of associated unit transducers is required for the same sound power capability.

In another modified form of the invention, each bit in the code word 12 may be utilized to drive a single sound pressure generating element or transducer, the area of each transducer being proportional to the bit value. A disadvantage of such an arrangement compared to the fixed size building block approach of the preferred embodiment described herein is a differing transient response characteristic among the various sizes of transducers and a slight increase in manufacturing complexity.

Thus, there has been provided according to the invention a direct digital loudspeaker comprising a plurality of substantially identical low inertia sound pressure generating elements or transducers, each of which transducers has a driver individually associated therewith for producing the discrete sound levels encoded in a digitally-encoded signal, with the transducers and associated drivers arranged in an array capable of producing the full range of the encoded sound, and with a plurality of such arrays connected in parallel and built up into larger speaker panels as required to produce a desired sound power capability.

What is claimed is:

1. The method of converting a digital signal to sound, said digital signal being encoded in a plurality of successive code words at a signal encoding frequency, the code words representing the analog sound pressure of an original audio signal, comprising the steps of:

selectively energizing the drivers of a plurality of substantially identical sound pressure generating elements in a pulsed form at the signal encoding frequency in a combination of drivers determined for each code word of the digital signal in accordance with the states of the individual bits thereof to produce sound pressure pulses, and decoding the digital signal by striking a listener's ear with the sum of the sound pressure pulses produced by said sound pressure generating elements.

2. The method as specified in claim 1 wherein air pressure produced by said sound pressure generating elements in response to each of the successive code words of the digital signal has a magnitude corresponding to the analog value of the respective code word, whereby a listener's ear receives the sum of the air pressure pulses as the analog sound pressure of the original audio signal.

3. The method as specified in claim 2 wherein each code word of the digital signal comprises a plurality of bits ranging in order from a most significant bit to a least significant bit, and wherein the drivers of said sound pressure generating elements are selectively energized in combinations in response to the respective order of the bits of each code word of the digital signal from the most significant bit to the least significant bit.

4. The method as specified in claim 3 wherein the drivers of said sound pressure generating elements are energized in combinations of decreasing arithmetic progression.

5. A transducer for converting a digital signal, received serially by code word, to pulsed sound at a pulse rate corresponding to the digital signal encoding rate, with the decoding of the digital signal occurring by striking a listener's ear with the pulsed sound comprising:

a plurality of substantially identical sound pressure generating elements each having a driver individually associated therewith, and means operative in response to each code word to selectively energize said drivers in a pulsed manner at the signal encoding frequency in a combination of drivers determined for each code word by the states of the individual bits thereof.

6. A transducer for converting a digital signal to sound, said digital signal having a plurality of bits ranging in order from a most significant bit to a least significant bit, presented serially in code words, comprising:

a plurality of substantially identical sound pressure generating elements each having a driver individually associated therewith, and means for selectively energizing said drivers in a pulsed manner at the signal encoding frequency in parallel in combinations of decreasing arithmetic progression in response to the respective order of said bits of the input signal from the most significant bit to the least significant bit.

7. A transducer for converting to sound a digital signal, said digital signal being presented serially in code words each of which has a plurality of bits ranging in order from a most significant bit to a least significant bit, that is encoded in a plurality of successive code words with the decoding of the digital signal occurring by striking a listener's ear with the pulsed sound, comprising, a plurality of substantially identical sound pressure generating elements, means for driving said sound pressure generating elements in a pulsed manner at the signal encoding frequency comprising a separate driver individually associated with each of said sound pressure generating elements, and means for selectively energizing said drivers in a pulsed manner at a signal encoding frequency in combinations in response to a respective order of said bits of each code word of the digital signal from the most significant bit to the least significant bit.

8. A transducer as specified in claim 7 wherein the digital signal is encoded to represent the analog sound pressure of an original audio signal, wherein each of said sound pressure generating elements is operative when driven to produce an air pressure variation adjacent thereto, wherein each successive sum of air pressure variations produced by said sound generating elements has a magnitude corresponding to the analog value of a respectively associated one of the code words, whereby a listener's ear, having the characteristics of a low pass filter, receives the sum of air pressure variations of said sound generating elements as the analog sound of the original audio signal.

9. A transducer as specified in claim 8 wherein said drivers are energized in combinations of decreasing arithmetic progression.

10. A transducer as specified in claim 8 wherein said sound generating elements are disposed in a side-by-side array.

11. A transducer as specified in claim 10 wherein said array is a planar array.

12. A transducer as specified in claim 10 wherein said array is a concave array.

13. A transducer as specified in claim 10 wherein said array is a convex array.

14. A transducer as specified in claim 10 wherein said array is mounted on a physically flexible substrate.

15. A transducer as specified in claim 10 wherein each sound pressure generating element of said array comprises a closed space filled with gas having first and second walls of electrically non-conducting film.

16. A transducer as specified in claim 15 wherein the driver for each of said sound pressure generating elements of said array includes a first conducting film in adhering contact with the outer surface of the first of said walls of non-conducting film, a second conducting film in adhering contact with the outer surface of said second of said walls of non-conducting film, and a third conducting film in adhering contact with the inner surface of said second one of said non-conducting films.

17. A transducer as specified in claim 16 wherein the code words of the encoded digital signal each have a plurality of bits ranging in order from a most significant bit to a least significant bit, and wherein the sound pressure generating elements of the array are arranged in groups with the number of sound pressure generating elements in each group corresponding to one of the bit orders of the encoded digital signal, and wherein the first conducting films of all of said sound pressure generating elements in said array are electrically connected to each other, the second conducting films of all of said sound pressure generating elements in said array are electrically connected to each other, and the third conducting films of only those sound pressure generating elements in the same group are electrically connected to each other.

18. A transducer as specified in claim 17 further including means to apply a direct current bias voltage between said first and second conducting films of said array thereby to compress slightly the gas in the closed space of each sound generating element due to electrostatic attraction between the first and second conducting films, and wherein said means to selectively energize said drivers includes circuit means to apply an alternating current signal voltage between said second and third conducting films of said groups of sound pressure generating elements, in a combination of third conducting films determined for each code word of the digital signal, by the states of the individual bits thereof, the maximum amplitude of the alternating current signal voltage being less than the amplitude of the direct current bias voltage whereby as the alternating current signal varies the gas in the closed spaces of the driven sound pressure generating elements is compressed to a greater or lesser extent due to the varying electrostatic attraction between the first, second and third conducting films.

19. A transducer as specified in claim 18 further including a plurality of such arrays of sound pressure generating elements connected in parallel.

20. A transducer for converting into sound a serial digital word representing the analog sound pressure of an original analog signal, said digital word being of the type having a plurality of bit locations including locations for a polarity bit and a plurality of magnitude bits ranging in order from a most to a least significant bit, comprising, means for converting the serial digital word into parallel form, converting means for converting each magnitude bit into an output voltage of a first polarity when a bit is present in the polarity bit location and for converting each magnitude bit into an output voltage of a second polarity, when a bit is absent from the polarity bit location, said output voltages being pulsed at a signal encoding rate, a plurality of substantially identical sound pressure generating elements disposed in a side-by-side array, the sound pressure generating elements in the array being arranged in groups with the number of sound pressure generating elements in each group corresponding to one of the bit orders of the serial digital word, each of said sound pressure generating elements comprising a closed spaced filled with gas having walls of non-conducting film opposed to each other, driving means for driving said sound pressure generating elements comprising a separate driver individually associated with each of the sound pressure generating elements of the array, each of said separate drivers including a first conducting film in adhering contact with the outer surface of one of said walls of non-conducting film, a second conducting film in adhering contact with the outer surface of the other wall of non-conducting film, and a third conducting film in adhering contact with the inner surface of one only of said non-conducting films, the first conducting films of all of said sound pressure generating elements being connected to each other, the second conducting films of all of said sound pressure generating elements being electrically connected to each other, and the third conducting films of only those sound pressure generating elements in the same group being electrically connected to each other, means to apply a direct current bias voltage between said first and second conducting films of the array of sound pressure generating elements thereby to compress slightly the gas in the closed space of each sound pressure generating element due to electrostatic attraction between the first and second conducting films, a switching network to connect the output of said converting means to said driving means with the third conducting films, the third conducting films of the group containing the largest number of sound pressure generating elements being connected to the output of said converting means corresponding to the most significant bit, and the third conducting film of the group containing the smallest number of sound pressure generating elements being connected to the output of said converting means corresponding to the least significant bit, the output of said converting means comprising an alternating current signal voltage having an amplitude less than the magnitude of the direct current bias voltage whereby as the alternating current signal voltage varies the gas in the closed spaces of the driven sound pressure generating elements is compressed to a greater or lesser extent due to the varying electrostatic pressure between the first, second and third conducting films causing the mutually opposed non-conducting films of the driven sound pressure generating elements to move compressing the external air at the surfaces thereof proportionally to the impressed alternating current signal voltage, producing sound waves, whereby a listener's ear, having the characteristic of a low pass filter, receives the sum of the air pressure produced by the driven sound pressure generators of the array as the analog sound pressure of the original audio signal.

21. A transducer for converting a digital signal to sound, said digital signal being presented serially in code words each of which has a plurality of bits ranging in order from a most significant bit to a least significant bit, a plurality of substantially identical sound pressure generating elements, a separate driver individually associated with each of said sound pressure generating elements, and means for selectively energizing said drivers in a pulsed manner at the signal encoding frequency in combinations in response to the respective order of said bits of each code word of the digital signal from the most significant bit to the least significant bit.

22. A transducer as specified in claim 21 wherein said drivers are selectively energized in parallel in combinations of decreasing arithmetic progression.

* * * * *